United States Patent [19]

Lane

[11] Patent Number: 4,756,265

[45] Date of Patent: Jul. 12, 1988

[54] HIGH SPEED BOAT LIFTING STRUCTURES

[76] Inventor: H. T. Lane, 164 Vermeer Dr., Langhorne, Pa. 19047

[21] Appl. No.: 896,129

[22] Filed: Aug. 12, 1986

[51] Int. Cl.[4] ..... B63B 1/20

[52] U.S. Cl. ..... 114/57; 114/274; 114/278; 114/280; 440/66

[58] Field of Search ..... 114/39.1, 39.2, 271, 114/274, 278, 280, 284, 126, 129, 132, 143, 56, 57; 440/66; 441/74, 79

[56] References Cited

U.S. PATENT DOCUMENTS

| | | | |
|---|---|---|---|
| 804,497 | 11/1905 | Palmer | 114/274 |
| 1,226,400 | 5/1917 | Smith | 440/66 |
| 3,230,918 | 1/1966 | Compton . | |
| 3,236,202 | 2/1966 | Quady et al. | 114/282 |
| 3,354,857 | 11/1967 | Hobday | 114/282 |
| 3,433,195 | 8/1967 | Poole . | |
| 3,456,611 | 7/1969 | Johnson | 114/282 |
| 3,598,076 | 8/1971 | Saxton . | |
| 3,604,384 | 9/1971 | Coles . | |
| 3,651,775 | 1/1972 | Kock . | |
| 3,709,180 | 1/1973 | Kobylinski et al. | 114/274 |
| 3,863,586 | 2/1975 | Hargett et al. . | |
| 4,027,614 | 4/1975 | Jones . | |
| 4,208,980 | 9/1978 | Henkel . | |
| 4,345,538 | 8/1982 | Warner et al. | 114/274 |
| 4,487,152 | 12/1984 | Larson | 114/271 |
| 4,492,176 | 1/1985 | Arima | 114/271 |
| 4,606,291 | 8/1986 | Hoppe | 114/61 |

FOREIGN PATENT DOCUMENTS

| | | |
|---|---|---|
| 1081063 | 12/1954 | France . |
| 678553 | 12/1964 | Italy . |
| 997188 | 7/1965 | United Kingdom . |

*Primary Examiner*—Joseph F. Peters, Jr.
*Assistant Examiner*—Stephen P. Avila
*Attorney, Agent, or Firm*—John Jamieson, Jr.

[57] ABSTRACT

A thrust collar is disclosed for mounting around the upper portion of the propeller of an inboard/outboard engine. Each thrust collar supports a horizontal hydrofoil wing extending laterally from the collar. A second, similar wing can be provided on an opposing side of the collar. Where the collar is used in pairs on paired engines on a catamaran hull, a single hydrofoil wing can be supported between the thrust collars. The thrust collar is preferably used in conjunction with hull lifting structures. One hull mounted hydrofoil structure is supported at the lower end of the strut extending and includes a generally curvilinear gull-wing shaped lower surface. For V-type hulls, a pair of elongataed mechanical lifting structures, symmetrically positioned on either side of the keel substantially in the vicinity of the keel are attached to the hull so as to extend generally traversedly to the sloping side surfaces of the hull intersecting at the keel. These lifting structures have a length many times greater than their maximum transverse dimension and preferably extend from a position approximately a midship beneath the hull to the stern of the hull. Retractable hydrofoil assemblies are described for drawing a strut supporting a hydrofoil wing into a boat or rotating the strut upward into a tunnel beneath the boat in the case of a catamaran hull.

18 Claims, 8 Drawing Sheets

HIGH SPEED BOAT LIFTING STRUCTURES

FIELD OF THE INVENTION

The invention relates to hydrofoil and similar lifting structures and, particular, new hydrofoil lifting structures suitable for use with high speed power boats.

For many years deep "V" hulled ocean going power boats were very popular for their perceived superior speed and handling. More recently, catamaran hulled craft of equal power and weight have been found to be capable of faster speeds and to have softer riding characteristics, greater stability and better fuel economy, primarily due to reduced drag of the hull.

It also has long been known that lifting surfaces or hydrofoils might be attached to various types of hulls, including both "V" and catamaran type hulls, for improved performance and/or speed. However, the use of such systems heretofore has been limited essentially to medium to low speed craft having a maximum operating speed of typically less than about 70 knots.

For example, U.S. Pat. Nos. 3,598,076, 3,651,775, 3,863,586 and 4,208,980 all depict "V" hull type power vessels with forward and rear hydrofoil systems of different configurations. U.S. Pat. No. 3,604,384, British Pat. No. 997,188 and French Pat. No. 1.081.063 all depict powered catamaran or twin hulled vessels with forward, rear or combination hydrofoil systems. U.S. Pat. No. 4,027,614 depict hydrofoil systems for use with catamaran sailboat hulls. Italian Pat. No. 678,553 also appears to relate to hydrofoils and/or lifting surfaces for use with twin hulled vessels.

U.S. Pat. No. 3,433,195 relates to a hydrofoil structure attached to the skeg of a contentional stern drive outboard motor below the propeller drive shaft for leveling the boat.

U.S. Pat. No. 3,230,918 relates to a ski-catamaran boat having a forward pair of skis and a rear pair of skis mounted to a pair of hulls which can be pivoted about their longitudinal axes with respect to a central, passenger carrying hull. The skis fixed to the floats of the depicted device are mechanical lifting bodies rather than true hydrofoils. Lift is generated by the vertical component of water pressure on the lower ski surface rather than by the generation of lift from differential fluid flow speeds over and under the device.

OBJECTS AND SUMMARY OF THE INVENTION

It is an object of the invention to provide new types of hull lifting structures suitable for extremely high-speed operations (up to about 100 knots or more), but which might also be used for medium and low speed craft.

It is yet another object of the invention to provide new types of lifting structures mountable to an outboard or outboard portion of an inboard/outboard marine motor unit.

It is yet another object of the invention to provide a new type of lifting structure which generates a vertical force, at least in part, from propeller thrown water.

It is yet another object of the invention to provide a new type of lifting structure suitable for retrofit mounting to conventional, cavitation plate equipped outboard or inboard/outboard motors.

It is yet another object of the invention to provide new types of lifting structures suitable for use with ocean going outboard and inboard/outboard craft up to about 60 feet in length.

It is yet another object of the invention to provide a new type of lifting structure for mounting proximal to the propeller of an outboard or inboard/outboard motor.

It is yet another object of the invention to provide a new type of lifting structure structure partially surrounding the upper portion of a propeller of an outboard or inboard/outboard which reduces propeller slippage or cavitation while developing a lifting force.

These and other objects will be satisfied by the mounting of a thrust collar mechanical lifting structure of the invention to an outboard or inboard/outboard motor including a propeller and a housing structure which is adapted for attachment to the stern of a boat for supporting the propeller beneath the water behind the stern of a boat and transmitting thrust generated by the propeller to the boat. Thrust collars of the invention are supported generally above and to either of two sides of the propeller so as to at least partially surround the propeller. Further according to the invention, at least a first hydrofoil wing is supported by and extends generally laterally away from a first side of the thrust collar and the partially surrounded propeller. For single-drive craft, a second hydrofoil wing, generally symmetric with the first wing, is provided extending generally laterally away from an opposing side of the thrust collar, propeller and first hydrofoil wing. In a twin engine configuration a second thrust collar, similarly mounting another pair of hydrofoil wings, can be used with the second propeller in a twin engine configuration. In yet another twin engine configuration of the invention, a pivotally mounted hydrofoil wing can be provided between a pair of thrust collars, each mounted over a propeller of a separate one of the engines in a twin engine configuration, to allow the thrust collars to pivot with the engines. An additional outwardly extending wing can also be provided on each collar in this configuration for a total of three wings.

Thrust collars of the invention include a top portion located generally over a propeller and a pair of side portions generally extending downwardly from said top portion to either of the aforesaid two sides of the propeller. For ease of manufacture, the top and side portions can be generally planar. Suggestedly, the side portions are rearwardly raked from the top portion as they extend generally away therefrom. For ease of mounting to existing engines, an upper surface of the top portion of the collar is planar to allow mounting of the collar against a planar lower surface of a cavitation plate of an outboard or inboard/outboard engine.

Also according to the invention, the top portion and pair of side portions of the thrust collar extend generally longitudinally with respect to the axis of rotation of the at least partially surrounded propeller and transverse cross-sectional areas of the first thrust collar encompassed by the top and two side portions decrease at some point along the thrust collar as it extends longitudinally away from the stern of the boat to which the engine is mounted.

According to yet another feature of the invention, the hydrofoil wing or wings supported by the thrust collar or thrust collars are supported at a height not lower than the hub of the partially surrounded propeller for high speed operation to prevent the propeller from being lifted from the water.

It is another object of the invention to provide a novel design for a high-speed, hull-mounted lifting structure.

It is yet another object of the invention to provide a novel hydrofoil structure particularly suited for catamaran hulled high performance speed boats.

According to the invention, it is proposed that these and other objects be accomplished by positioning beneath and supporting from a boat hull, symmetrically on either of two sides of the hull, a pair of symmetrically configured hydrofoil structures, each having a wing structure which is characterized by a lower surface having, at least in a vertical, transverse cross-sectional view, a generally curvilinear gull-wing shape and in vertical, longitudinally extending cross-sectional views generally airfoil shapes. Preferably, each of said pair of hydrofoil structures further includes a pair of stabilizers extending vertically downwardly along either side edge of each wing structure.

It is yet another object of the invention to provide new hull mounted high-speed mechanical lifting structures for use with "V" type hulls.

It is yet another object of the invention to provide hull mounted high-speed mechanical lifting structures for "V" type hulls which improve the roll stability of such craft at high speeds.

According to the invention, it is proposed that these and other objects be accomplished by positioning on either side of a substantially planar keel, extending from a point approximately amidship on the bottom of a V type hull to the stern of the hull, a pair of elongated keel lifting structures. These structures are positioned substantially in the vicinity of the keel and are attached to the hull so as to extend generally transversely to the sloping side surfaces of the hull intersecting at the keel. The structures are particularly characterized in having a length many times greater than their maximum transverse dimension. Further according to this aspect of the invention, the elongated keel lifting structures extend along the hull approximately co-extensively with the planar portion of the keel, i.e. from a position approximately amidship to approximately the stern of the hull.

It is a further object of the invention to provide retractable, hull mounted hydrofoil structures so as to reduce the operating draft of the boat during low and no speed operation.

It is a further object of the invention to accomplish the above object by retraction of hydrofoil structures into the hull of the boat supporting the structures.

It is a further object of the invention to provide hull retractable hydrofoil structures adapted particularly for use with catamaran type hulls.

According to the invention, it is proposed that these and other objects be accomplished by providing a pair of hydrofoil wing support struts positioned generally symmetrically with respect to and extending generally downwardly from a lower surface of the hull, supporting one or a pair of hydrofoil wings at an extreme lower end thereof and further providing within the hull suitable means coupled to an upper end of each of the struts which is adapted for raising the struts from an extended position beneath the hull to a retracted position also beneath the hull. According to this aspect of the invention and with respect to catamaran type hulls, in particular, having a pair of sponson sections and a raised center section extending between and connecting upper portions of the two sponson sections to form a tunnel beneath the hull, each strut is supported from a separate one of the pair of sponson sections and raised vertically. In one proposed configuration, each is raised into its supporting sponson section. In another proposed configuration, each strut is raised by being rotated about an axis transverse to a central longitudinal vertical plane through the hull to a position beneath the center section. In yet another proposed configuration, each sponson is raised by being rotated about an axis parallel to that vertical plane into the tunnel.

Other aspects of the invention will become apparent to those skilled in the art upon review of the accompanying drawings and following detailed description of the invention.

DETAILED DESCRIPTION OF THE INVENTION

Figure 1:
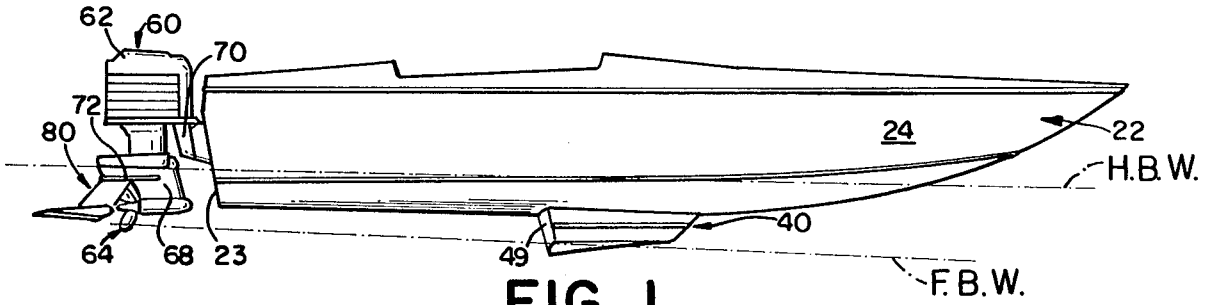
FIG. 1 is a diagrammatic side elevation view of a high speed unstepped catamaran with twin outboard engines equipped with hydrofoil lifting systems of the invention.
Figure 2:
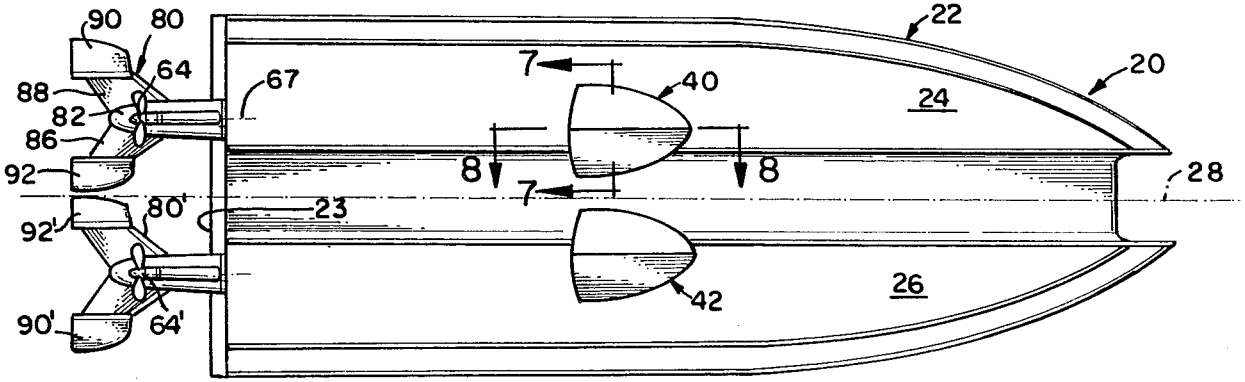
FIG. 2 is a diagrammatic bottom view of the craft of FIG. 1.
Figure 3:
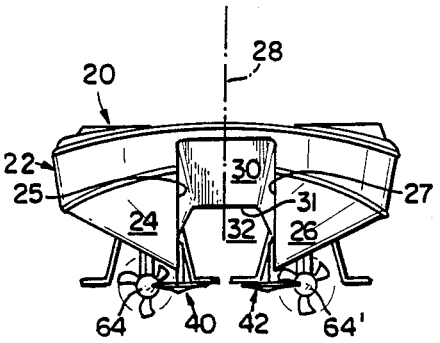
FIG. 3 is a diagrammatic front elevation view of the craft of FIGS. 1 and 2 omitting the thrust collars and supported hydrofoil wings for clarity.
Figure 4:
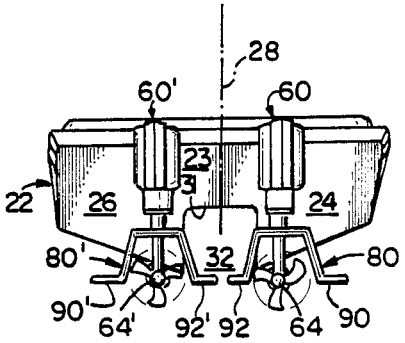
FIG. 4 is a diagrammatic rear elevation view of the craft of FIGS. 1, 2 and 3 omitting the hull mounted hydrofoil structures for clarity.

FIGS. 1 through 4 depict in varying views, an ocean going speed boat 20 incorporating envisioned preferred aspects of the invention. The speed boat 20 includes an unstepped catamaran type hull 22 but stepped and multi-stepped hulls might also be used. As best seen in FIGS. 2 through 4 the hull 22 includes a pair of sponson sections 24 and 26, substantially if not identically symmetric with respect to a vertical plane 28 (FIGS. 2 and 3) extending longitudinally through the center of the boat 20, and a raised center section 30 extending between and connecting the upper portions of the pair of sponson sections 24 and 26 forming a tunnel or channel 32 (FIGS. 3–4) extending beneath the hull. The tunnel 32 is defined by the lower surface 31 of the raised center section 30 and facing inner side surfaces 25 and 27 (FIGS. 3–4) of the two sponson sections 24 and 26, respectively. Positioned beneath and supported from each of the sponson sections 24 and 26, approximately amidship, are hydrofoil structures 40 and 42 discussed shortly with respect to FIGS. 7 through 9. The two hydrofoil structures 40 and 42 are mirror images of one another both in form and in position with respect to the central plane 28. It is envisioned that the hull 22 will be formed of the new S-type glass fiber and resin for strength although the older E-type glass fiber and resin system might be used.

The boat 20 is further equipped with conventional, identical, twin marine outboard engines 60 and 60′ (FIG. 4). One such engine 60, seen in profile in FIG. 1, includes an upper housing section 62 enclosing a conventional gasoline engine, a propeller 64 and a lower housing section 68 housing the remainder of the drive train extending between the engine and the propeller 64 and supporting the same. The bottom part of the lower housing section 68 and propeller 64 are shown in an enlarged view in FIG. 5 where the hub 65, vanes 66 and axis of rotation 67 of the prop 64 are indicated. The engine 60 is attached to the transom 23 of the hull 22 by conventional mounting means depicted generally at 70 and incorporated into the top part of the lower housing section 68. The mounting means 70 not only supports the engine 60 from the hull 22 but also transmits thrust developed by the propeller 64 to the hull 22. The lower housing section 68 of the engine 60 further includes a conventional cavitation plate 72 which is a generally horizontal member having a substantially planar lower surface 73 (see FIG. 5) extending over the propeller 64 from an essentially vertically oriented remainder of the lower housing section 68.

Figure 5:
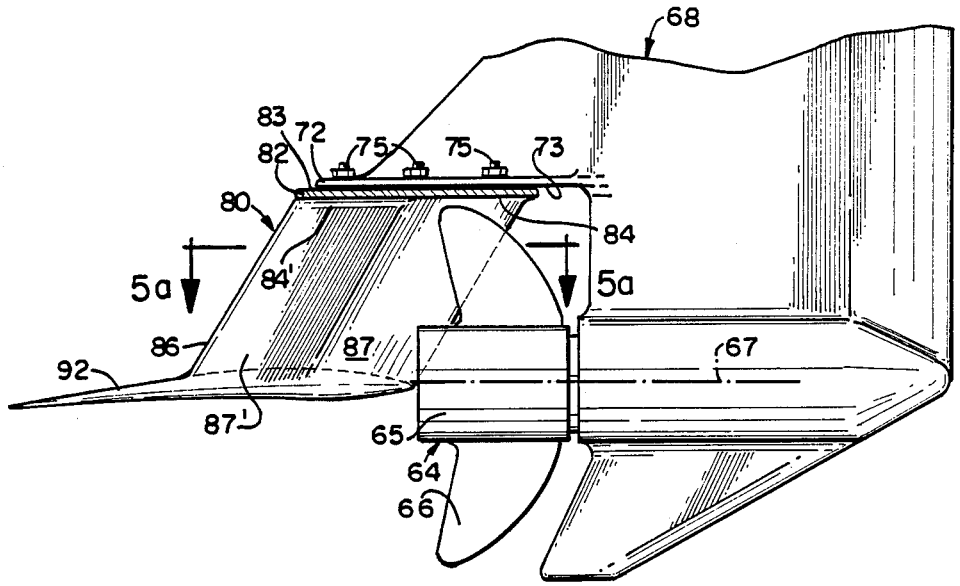
FIG. 5 is a diagrammatic longitudinal side sectioned view of the starboard thrust collar of FIGS. 1,2 and 4 and part of supporting lower motor housing.

As seen in FIGS. 1, 2, 4 and 5 the engine 60 supports a thrust collar 80 of the invention. As best seen in FIG. 5, the thrust collar 80 includes a top portion 82 (which has been sectioned) and a pair of side portions 86 and 88, respectively, only one of which 86 is seen in FIG. 5. In the depicted embodiment, the side portions 86 and 88 extend generally downwardly and outwardly from the top portion 82 along either of the two sides of the top portion 82. The upper surface 83 of the top portion 82 is substantially planar to allow the thrust collar 80 to be mounted to the planar lower surface 73 of the cavitation plate 72 by nuts 74 and bolts 75 or other conventional means. This particular thrust collar configuration is therefore extremely suited for retrofit on existing outboard and inboard/outboard engines.

As seen in the FIGS. 1, 2, 4 and 5, the collar 80 is supported generally above and to either of two sides of the propeller 64, at least partially surrounding the upper portion of the propeller. As best seen in FIGS. 1 and 5, the side portions 86 and 88 of the thrust collar 80 are rearwardly raked from the top portion 82 as they extend away from either side of the top portion 82. When fully submerged, the thrust collar 80 is intended to reduce slippage of and cavitation generated by the prop. The side portions 86 and 88 additionally act as vertical stabilizers. At high speeds, when the collar may be lifted partially out of the water, the collar generates lift from water thrown against its inner surfaces 84, 87 and 89 by the prop 64. The thrust collar also reduces drag on the prop 64 by lifting it out of the water thereby reducing stress on the drive train components. This, in combination with the more effective bite resulting from reduced slippage and cavitation, is envisioned to allow the use of an increased pitch propeller, up to about 35 to 37 inches, verses conventional props with 25 to 30 inch pitch. (Pitch is the distance advanced by a propeller in one complete rotation).

As seen in the various FIGS. 2 and 4, there is supported at the lower end of each side portion 84 and 86, a separate hydrofoil wing 92 and 90, respectively. The hydrofoil wing 92 extends generally laterally away from the supporting side portion 84 of the thrust collar and from the propeller 64. The second wing 90 is generally symmetrically configured and positioned with respect to the first wing 92, extending generally laterally away from the remaining side portion 86 of the collar and from the propeller 64 and first wing 92. The wings 90 and 92 are surface piercing although they may plane at top speeds. Longitudinal side sections of each of the hydrofoil wings 90 and 92, reveal an airfoil shape for generating lift as the boat 20 moves forward through the water. The cross-sectional form of wing 92 is depicted in FIG. 5 by a combination of solid and broken lines indicating the portion of the wing hidden in that view by side portion 86 of the collar 80. It is envisioned that the thrust collars will be formed by extrusion of a suitable metal such as 5250 Al marine grade aluminum, preferably with extensions that may be machined into the supported hydrofoil wings 90,92,90′, 92′.

A second motor 60′, second thrust collar 80′ attached to and supported by a cavitation plate portion of the lower housing 68′ that motor 60′ and hydrofoil wings 90′ and 92′ supported by the second thrust collar 80′ are substantially identical to the first motor 60, thrust collar 80 and wings 90 and 92 and are substantially symmetrical to those elements in configuration and position with respect to the central longitudinal plane 28 of the hull.

Figure 5A:
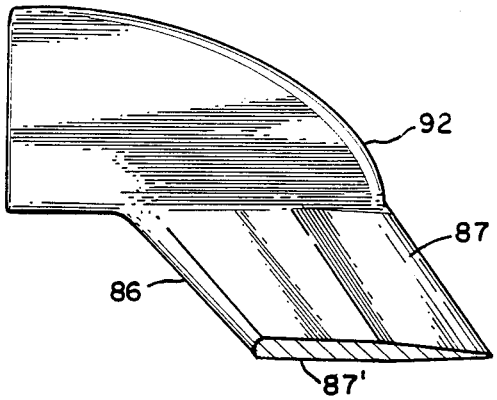
FIG. 5*a* is a diagrammatic view of the thrust collar along 5—5 of FIG. 5
Figure 6:
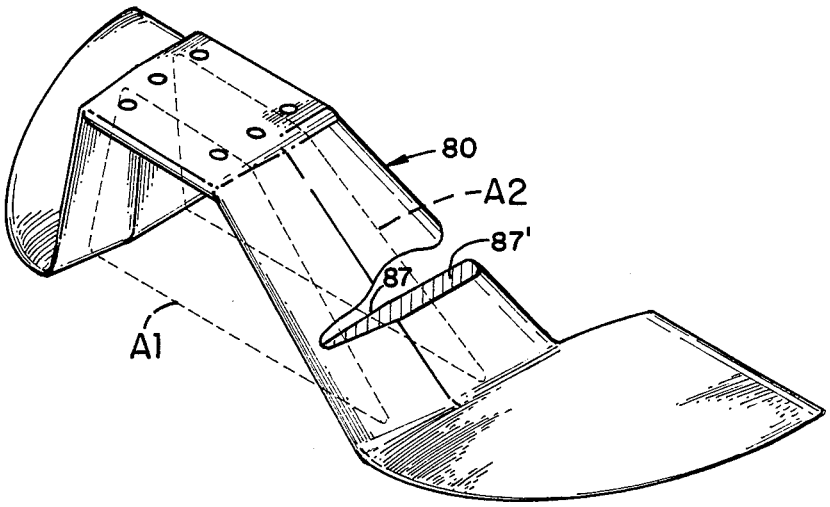
FIG. 6 is a diagrammatic illustration of the changing transverse cross-sectional areas defined by the interior walls of the thrust collar of FIGS. 1, 2, 4 and 5.

Referring again to FIG. 5, there can be seen the inner surface 87 of the side portion 86 as well as the upper and lower surfaces 83 and 84 of the top portion 82 of the thrust collar 80. These surfaces 83, 84 and 87 extend generally longitudinally with respect to the axis of rotation 67 of the propeller 64, as does the inner surface 89 of the side portion 88, not depicted. There is provided along the inner surface 87, an inwardly projecting or "raised" portion 87'. This is also seen in FIG. 5*a* and 6. A similar raised portion is provided along the inner surface of side 88 opposite the raised portion 87'. The lower surface 84 of the top portion 82 likewise contains a downwardly projecting portion 84' extending between the upper extremes of the inwardly projecting surface portion 87' and that of surface 89 to form a restriction or restricted transverse cross sectional area within the thrust collar 80 as the collar extends longitudinally away from the stern of the boat 20. This reduction in transverse area is best seen in FIG. 6 where there is depicted in broken lines, transverse cross-sectional areas A1 and A2, defined by the inner surfaces of the two side portions 86 and 88 and the top portion 82 before and along the protruding surface portions of the collar 80, respectively. The greater area A1 is located closer to the boat than is the restricted area A2 of the collar. The purpose of the restriction is to increase the flow speed of the water away from the prop.

Figure 7:
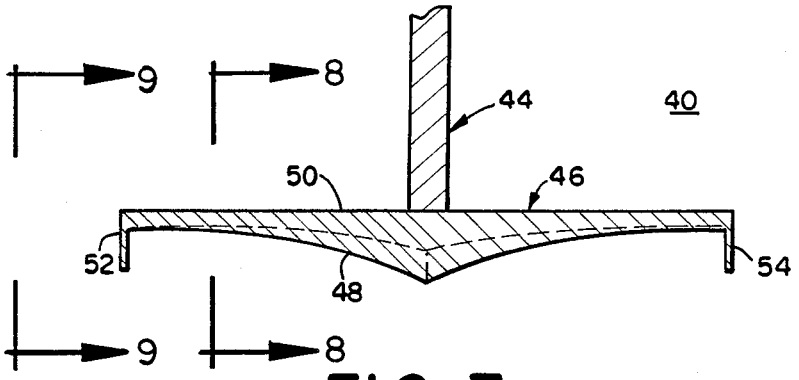
FIG. 7 is a diagrammatic transverse local sectional view along the line 7—7 of FIG. 1 of the hull mounted hydrofoil structure.
Figure 8:
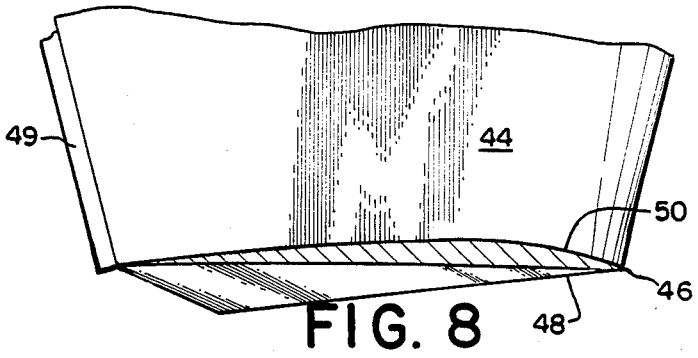
FIG. 8 is a diagrammatic longitudinal local sectional view along the lines 8—8 of FIG. 2 of the hull mounted hydrofoil structure.
Figure 9:
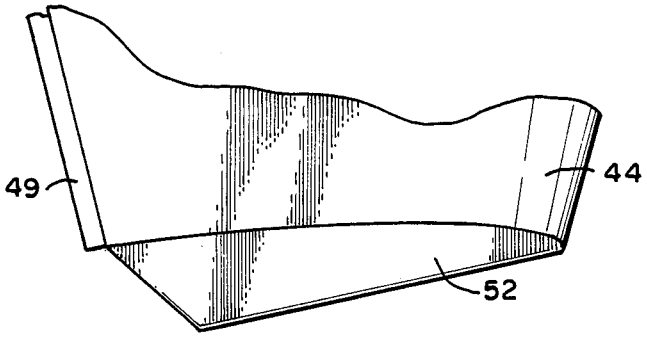
FIG. 9 is a diagrammatic local side elevation along lines 9—9 of FIG. 7 illustrating the hydrofoil wing side plates.

Refer now to FIGS. 7 and 8 where hydrofoil structure 40 is depicted. It should be understood that hydrofoil structure 42 is a mirror image of the depicted structure 40. The structure 40 includes a vertical strut member 44 having an upper end supported from the sponson section 24 and supporting transversely at its lower extremity a wing 46. The wing includes a lower surface 48 which, as best seen in FIG. 7, has a generally curvilinear gull-wing shaped transverse cross-sectional configuration and an upper surface 50 which, as best seen in FIG. 8, forms with the lower surface 48 a general airfoil shape when viewed through vertical, longitudinally extending cross sections of the wing structure. At the extreme side edges of the wing 46 there are provided generally vertically downwardly extending stabilizers 52 and 54. If desired, a water inlet pipe 49 can be mounted along the rear edge of the strut 44, as depicted in FIG. 8, to draw water for engine cooling or a speedometer or other conventional uses. FIG. 9 illustrates the shape of stabilizer 52. Stabilizer 54 is symmetric to 52. It is envisioned the hydrofoil structures 40 and 42 will be formed by machining a single piece extrusion. An alternative preferred construction is a welded wing and brace. In addition to the aforesaid 5250 Al aluminum, stainless steel and perhaps glass fiber and resin over a frame are envisioned to be appropriate construction materials.

The boat 20 and components previously discussed are designed for high speed operation. Accordingly, a surface piercing type of propeller 64 would be employed. For such envisioned high speed operations, the wings 90 and 92 supported by the thrust collar 80 would be mounted to the thrust collar 80 so as to be at a height not lower than the hub 65 of the propeller 64. In this position, it is envisioned that the wings 90 and 92, may actually plane on the surface of the water at top speed but should, nonetheless, be designed for surface piercing operation. Indicated in FIG. 1 are the hull born water line "HBW" and the foil born water line "FBW" envisioned for high speed operation. A 4.5°±2° angle of attack to the FBW is suggested for all of the various hydrofoil wings 46, 90, 90', 92 and 92.

Figure 10:
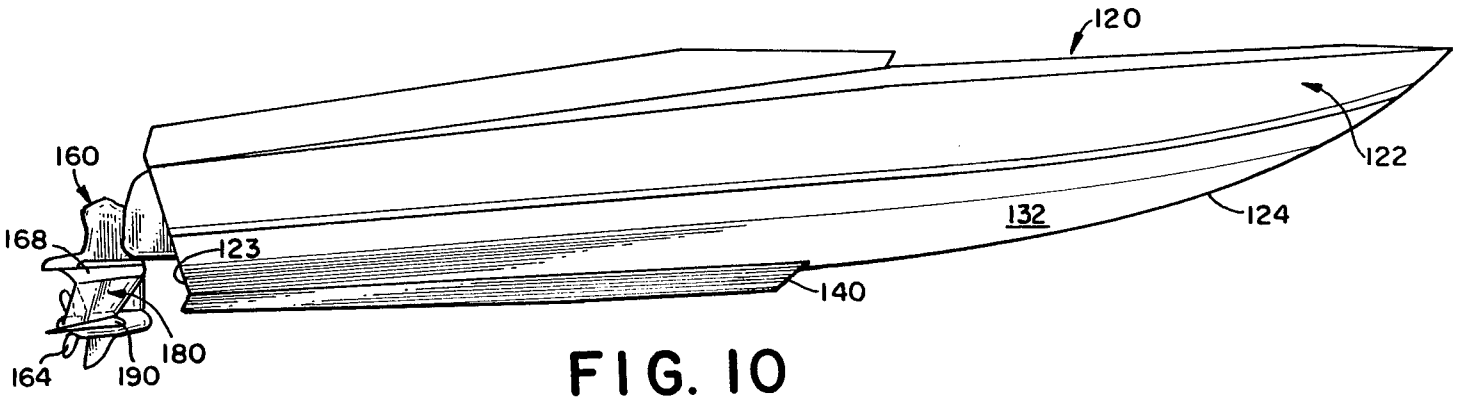
FIGS. 10 through 12 are diagrammatic side elevation, bottom and front elevation views, respectively, of a deep V hulled speed boat with twin inboard/outboard motor drives incorporating hull mounted, longitudinally extending elongated keel lifting structures and a pair of thrust collars.
Figure 11:
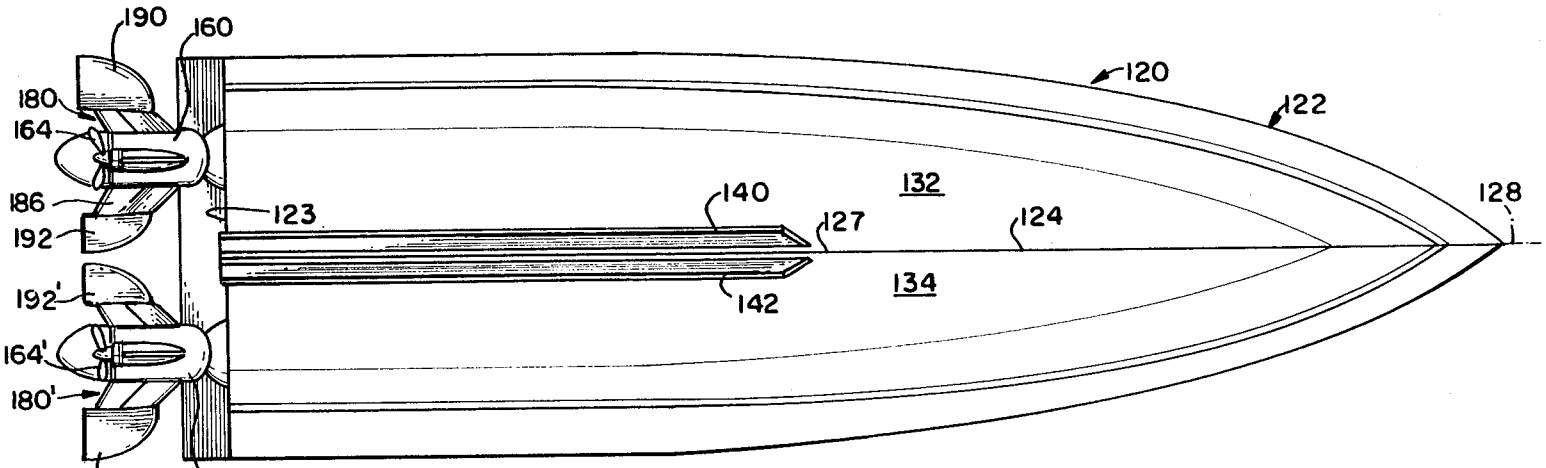
Figure 12:
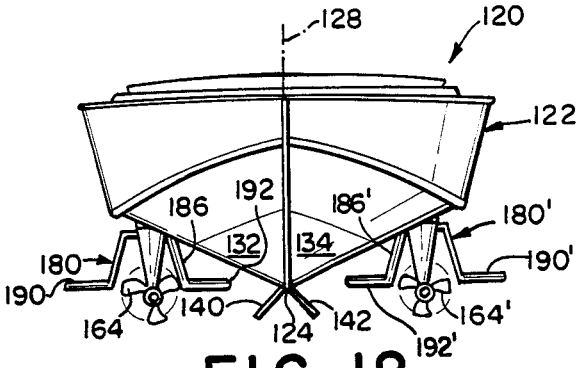

Depicted in FIGS. 10 through 12 is a second speed boat 120 incorporating a number of other envisioned embodiments of the invention. The speed boat 120 includes a deep "V" type hull 122 having a keel 124 with a substantially planar portion extending from a point 127 approximately amidship to the stern 123 of the hull. Sloping side surfaces 132 and 134 of the hull intersect at the keel 124. The speed boat 120 is equipped with identical inboard/outboard engines 160 and 160' extending through the transom forming the stern 123 of the hull 122. Supported at the extreme lower end of each exposed motor housing 168 and 168' is a prop 164 and 164', respectively. Supported from the lower surface of a cavitation plate or other suitable portion of the exposed housing 168 and 168' of each of the engines, is a thrust collar 180 and 180', respectively, each supporting an outer wing 190 and 190', respectively, and symmetrical inner wings 192 and 192', respectively. Again, each of the thrust collars 180 and 180' is positioned to extend generally above and to either of two sides of a propeller 164 and 164' associated with each engine 160 and 160', respectively.

Figure 13:
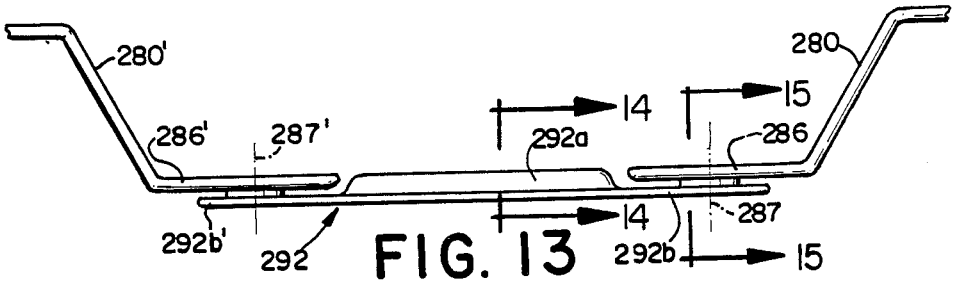
FIG. 13 is a diagrammatic front elevation illustrating one possible pivotal mounting of a hydrofoil wing to a pair of thrust collars of the invention.
Figure 14:
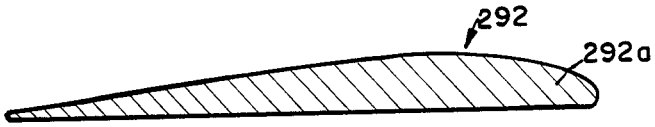
FIG. 14 is a diagrammatic local side section of the hydrofoil wing along lines 14—14 of FIG. 13.

As is depicted in FIG. 13, a hydrofoil wing 292 can be pivotally mounted to the bottom of "wings" 286 and 286' of thrust collars 280 and 280', respectively, which are essentially flanges modified to support the central wing 292. The wing 292 rotates about axes 287 and 287', respectively, enabling the thrust collars 280 and 280' to pivot with the engines on which they are mounted. Each collar 280, 280' includes a conventional horizontal hydrofoil wing opposite the flange 286, 286', respectively, omitted from FIG. 13 for clarity. As can be seen from FIGS. 13 and 14 a central portion 292*a* of the pivotally mounted wing 292 has a conventional lifting foil configuration. The center foil portion 292*a* tapers down along either side to a pair of support plate portions 292*b* and 292*b*'. It is envisioned that each of these support plate portions will be pivotally coupled with an adjoining one of the thrust collar flanges 286 and 286' by conventional means such as a headed pin 288 and receiving socket 289 depicted in FIG. 15 between flange 286 and support plate portion 292*b*. The central wing 292 and pair of thrust collars 280, 280' are envisioned for installation on catamaran configured hulls like 22 of FIG. 1.

As best seen in FIGS. 10 through 12, there is attached to either sloping side surface 132 and 134 of the hull 122 so as to extend generally normally therefrom, a pair of elongated, mechanical keel lifting structures 140 and 142, symmetrically positioned on either side of the keel 124 substantially in the vicinity of the keel. Each of the elongated hydrofoil structures extends along the hull from a position approximately amidship 127 to approximately the stern 123 of the hull. Plane 128 depicted in FIGS. 11 and 12 is again a plane of symmetry for the hull 122, lifting structures 140 with 142, engine 160 with 160', collar 180 with 180' and the three rear hydrofoil wings, 190 with 190' and 192. An envisioned exemplary pair of lifting structures for use with craft about 30 feet in length would each be about 15 feet long, 4 inches wide (normal dimension from hull and spaced about 4 inches from the center of the keel).

Figure 16:
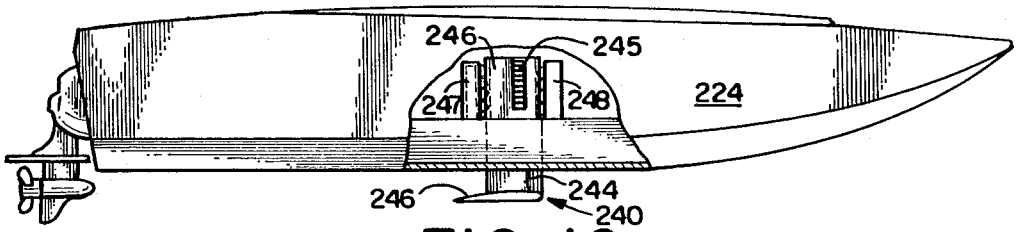
FIGS. 16 and 17 are diagrammatic side and front views, respectively, of one configuration for vertically raising a hull supported hydrofoil structure into the sponson of a catamaran type hull.
Figure 18:
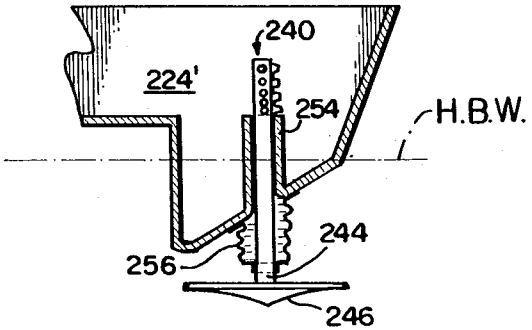
FIG. 18 is a diagrammatic front sectioned view of an alternative mounting.
Figure 17:
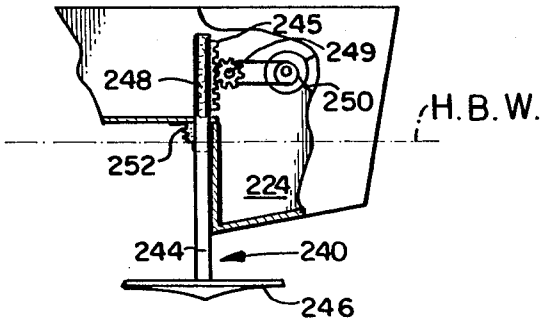

Another aspect of the invention is the retractability of hull mounted hydrofoil structures to reduce draft and drag. In particular, a number of configurations are envisioned for use with catamaran type hulls. One envisioned embodiment is depicted in FIGS. 16 and 17 with respect to hull mounted hydrofoil structures like the structures 40 and 42 previously described with respect to FIGS. 1 through 3, 7 and 8. In this embodiment, the strut 244 of the structure 240 is vertically raised to draw the supported wing 246 much closer or actually against the lower portion of the sponson 224 supporting the structure 240. The strut 244 includes a multiplicity of teeth 245 on a substantially planar surface 246 thereof.

Figure 15:
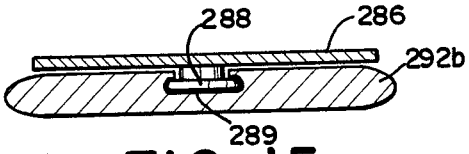
FIG. 15 is a diagrammatic local side section of a support arm of the hydrofoil wing and supporting thrust collar along lines 15—15 of FIG. 13 illustrating one possible pivotal support.

The plate 244 is vertically slidable in a pair of ball bearing tracks 247 and 248 mounted to the sponson section 24. The toothed portion of the plate 244 is preferably located within the sponson itself for protection from the elements and extends through an opening in the inner side of the sponson above the hull born water line HBL as indicated in FIG. 15. A gear 249 meshing with the teeth 245 of the strut 244 and driven by a motor 250 raises and lowers the hydrofoil structure. A diagram seal 252 can be provided as is depicted in FIG. 17 to at least partially cover the upper end of the strut and exposed portions of the strut raising system where the strut 244 extends from an inner sponson 224.

Alternatively the strut 244 can be extended from a sponson 224' through a well 254, preferably sealed by suitable means such as a rubberized fabric boot 256 circumferentially surrounding both the strut 244 and the well 254 and attached to the strut 244 and sponson hull 224 where it is broken by the well 254.

Figure 19:
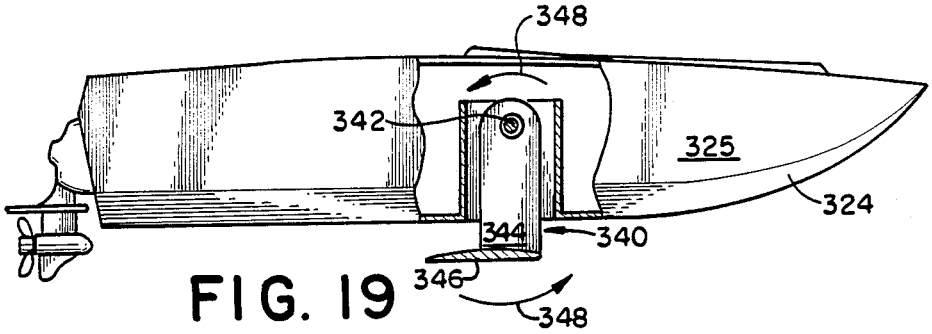
FIG. 19 is a diagrammatic, partially sectioned side view, of a second configuration for rotating a hull supported hydrofoil structure into the tunnel formed between the sponsons and beneath the center portion of a catamaran type hull configuration.
Figure 20:
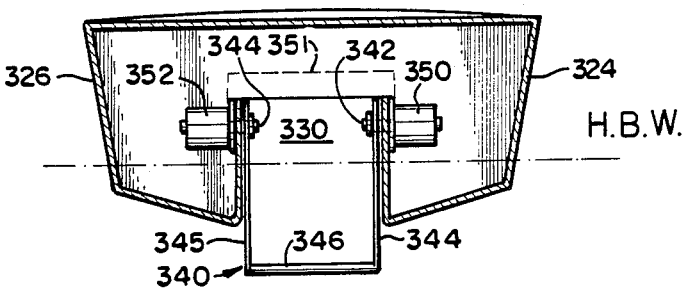
FIG. 20 is a diagrammatic local section front view of the FIG. 19 embodiment.

FIGS. 19 and 20 depict diagrammatically a second envisioned hydrofoil structure and mode of retraction. In this embodiment, a hydrofoil structure 340 having a strut 344 and a wing 346, is connected at the upper end of the strut with an axle 342, passing through the inner side wall 325 of the supporting sponson section 324 and coupled with a motor 350 to rotate the structure in a counter-clockwise direction, as indicated by the arrows 348 in FIG. 19, raising the connected wing structure 346 forward into the tunnel formed between the sponson section 324 and a like section of the hull. As seen in FIG. 20, the wing 346 is also supported by a second strut 345 mounted to the remaining sponson 326 by an axle 347. The strut 345 may be freely rotating or driven in unison with strut 344 by a conventional, mechanical drive train from motor 350 diagrammatically indicated by broken line 351 for clarity, or another motor 352. In this embodiment the hull can be substantially if not effectively sealed by passing the shafts 342 and 347 through suitable bearings supported in each sponson inner wall.

Figure 21:
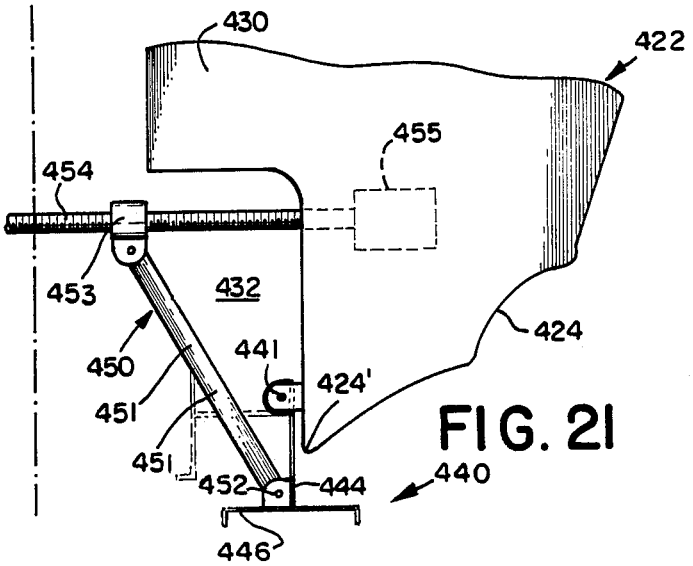
FIG. 21 is a diagrammatic sectioned view of a third envisioned configuration for rotating a hull supported hydrofoil structure into the tunnel provided between the sponson and beneath the center portion of a catamaran type hull configuration.

A third envisioned hydrofoil structure is illustrated diagrammatically in FIG. 21 which depicts one sponson 424 and part of a central portion 430 of a catamaran hull 422. Supported by the sponson 424 is a hydrofoil assembly 440 including a strut 444 supporting a hydrofoil wing assembly 446. The strut is pivotally mounted to the sponson 424 by suitable means such as a hinge 441 located sufficiently above the keel 424' of the sponson so that the assembly 440 can be rotated about an axis defined by hinge 441 parallel to the central longitudinal plane 428 of the hull into the tunnel area 432 reducing draft. The assembly 440 can be raised and lowered by any of a variety of mechanical, hydraulic or combination mechanical/hydraulic linkages, an envisioned one of which is depicted. The linkage, indicated generally at 450, includes an arm 451 pivotally mounted at one end to the pivoting portion of the assembly 440 by pin 452 and to a threaded knuckle 453 at its opposing end. The knuckle 453 is supported on a threaded shaft 454 extending between sponsons and driven by a reversible electric motor 455. A similar system can be provided on the second sponson for a second hydrofoil assembly. The strut 451 (and its counterpart controlling the second hydrofoil assembly) can be bent so that a pair of struts and supporting threaded shafts can be provided longitudinally spaced from one another in the tunnel 430.

While unstepped catamaran hull configurations have been depicted in various ones of the figures, the inventions described could be used in conjunction with multi-stepped hulls. Moreover, those skilled in the art will appreciate that the various structural characteristics of the thrust collar, including shape, size, length, position with respect to and degree of encirclement of the propeller, as well as the degree of rake, outward and downward projection, etc. will impact different operating characteristics such as, maximum thrust, maximum speed, optimum handling and stability at desired speeds, etc. It is envisioned that the structures of the subject invention can be suitably constructed from known materials such as marine grade 5250 aluminum, but that other known materials including stainless steel would be suitable. Although motors and gearing have been described as the suggested means of raising and lowering hull supported hydrofoil structures, it will be apparent to those skilled in the art that other systems might be employed, particularly hydraulic systems, to raise and lower hull supported hydrofoil structures beneath hulls.

While various aspects of the invention have been described and modifications thereto suggested, those skilled in the art will be aware of other possible modifications and variations to my invention. Therefore, my invention is not limited to the described embodiments, but rather is defined by the scope of the accompanying claims.

I claim:

1. A marine drive system for a boat comprising:

a first propeller having a central hub portion;

housing means adapted for supporting and propeller beneath the stern of the boat and for transmitting thrust generated by the propeller to the boat;

a first thrust collar supported by said housing means generally above and to either of two sides of said first propeller, partially surrounding said first propeller; and a first hydrofoil wing supported by and extending generally laterally away from a first side of said first thrust collar and said first propeller, said hydrofoil wing being disposed substantially behind said propeller at a height not lower than said hub for generating a vertical lift to the stern of the boat, at least in part, from propeller thrown water.

2. The marine drive system of claim 1 further comprising:

a second hydrofoil wing generally symmetric with said first hydrofoil wing and supported by and extending generally laterally away from an opposing side of said first thrust collar, said first propeller and said first hydrofoil wing.

3. The marine drive system of claim 1 further comprising:

a second propeller;

additional housing means adapted for supporting said second propeller beneath the stern of the boat and for transmitting thrust developed by said second propeller to said boat;

a second thrust collar substantially symmetric with the first thrust collar and supported by said additional housing means generally above and to either of two sides of said second propeller, partially surrounding said second propeller; and a second hydrofoil wing substantially symmetric with said first hydrofoil wing, supported by and extending generally laterally away from one side of said second thrust collar and said second propeller and away from said first thrust collar.

4. The marine drive system of claim 3 further comprising:

a third hydrofoil wing means extending between said first and second thrust collars, pivotally mounted with respect to each of said first and second thrust collars.

5. The marine drive system of claim 3 further comprising:

a third hydrofoil wing supported by and extending generally laterally away from a remaining side of said first thrust collar and a remaining one of the two sides of said first propeller and towards said second thrust collar; and a fourth hydrofoil wing generally symmetric with said third hydrofoil wing supported by and extending generally laterally away from a remaining side of said second thrust collar means and a remaining one of the two sides of said second propeller and towards said first thrust collar.

6. The marine drive system unit of claim 3 in a combination further comprising:

boat hull means supporting said housing means and additional housing means; and additional hydrofoil wing means supported by and extending beneath said hull means.

7. The marine drive system of claim 1 wherein said thrust collar comprises a top portion located generally over said propeller, and a pair of side portions extending generally downwardly and rearwardly raked from said top portion to either of said two sides of said propeller.

8. The marine drive unit of claim 7 wherein said top portion and said pair of side portions of the first thrust collar extend generally longitudinally with respect to an axis of rotation of said first propeller and cross-sectional areas of the first thrust collar transverse to said axis and encompassed by said top and two side portions of said first thrust collar decrease at some point along said thrust collar as the collar extends longitudinally away from the boat for increasing the flow speed of water away from the prop.

9. The marine drive unit of claim 1 wherein said housing means further includes a cavitation plate extending above said first propeller and having a substantially planar lower surface; and wherein said first thrust collar means has a substantially planar upper surface positioned against said substantially planar lower surface of said cavitation plate.

10. A combination comprising:

a boat hull;

a pair of symmetrically configured hydrofoil structures positioned beneath and supported from said hull on either of two sides of said hull, each said hydrofoil structure being substantially symmetric both in form and position with respect to a longitudinal central plane through the hull and including a vertical strut means and a wing means substantially centrally supported at a lower end of the strut means and having generally curvilinear gull-wing shaped lower surface;

a first propeller having a central hub portion;

housing means adapted for supporting the propeller beneath the stern of the boat and for transmitting thrust generated by the propeller to the boat;

a first thrust collar supported by said housing means generally above and to either of two sides of said first propeller, partially surrounding said first propeller; and a first hydrofoil wing supported by and extending generally laterally away from a first side of said first thrust collar and said first propeller, said hydrofoil wing being disposed behind said propeller at a height not lower than said hub for generating a vertical lift to the stern of the boat, at least in part, from propeller thrown water.

11. The combination of claim 10 wherein each wing means of said pair of hydrofoil structures further has an air foil shape.

12. The combination of claim 11 wherein each of said pair of hydrofoil structures further includes a pair of stabilizers extending vertically downward along either side edge of each wing means.

13. The combination of claim 10 further comprising:

a pair of midship strut means positioned generally symmetrically with respect to and extending generally downwardly from a lower surface of said hull for supporting at least one hydrofoil structure;

midship hydrofoil wing means supported on an extreme lower end of each of said pair of strut means;

raising means within said hull and coupled to an upper end of each of said midship strut means and adapted for raising said midship strut means and connected midship hydrofoil wing means from an extended position beneath said hull to a retracted position also beneath said hull.

14. The vessel of claim 13 wherein said hull is of a catamaran configuration having a pair of sponsons and a raised center section extending between and connecting upper portions of the pair of sponson forming a tunnel extending beneath the hull and wherein each midship strut means extends from a separate one of the pair of sponson sections.

15. The vessel of claim 14 wherein said raising means is adapted for retracting an upper portion of each midship strut means vertically.

16. The vessel of claim 14 wherein said raising means is adapted for rotating each midship strut means about an axis transverse to a central longitudinal vertical plane through the hull to a retracted position beneath said center section of the hull.

17. The vessel of claim 14 wherein said raising means is adapted for rotating each midship strut means about an axis parallel to a central longitudinal vertical plane through the hull to a retracted position beneath said center section of the hull.

18. The vessel of claim 14 wherein said midship hydrofoil wing means is a single hydrofoil wing extending beneath the center section of the hull between said pair of midship strut means.

* * * * *